US007946887B1

(12) United States Patent
Zhang et al.

(10) Patent No.: US 7,946,887 B1
(45) Date of Patent: May 24, 2011

(54) COMBO ELECTRICAL CONNECTOR

(75) Inventors: George Huanyi Zhang, Irvine, CA (US); Bin Pan, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/752,442

(22) Filed: Apr. 1, 2010

(51) Int. Cl.
*H01R 31/648* (2006.01)

(52) U.S. Cl. ..... 439/607.23

(58) Field of Classification Search ..... 439/607.23, 439/607.01, 607.11, 607.12, 79, 638, 639, 439/660, 297, 680, 83
See application file for complete search history.

(56) References Cited

U.S. PATENT DOCUMENTS 6,331,122 B1 * 12/2001 Wu ..... 439/567
2009/0042451 A1 * 2/2009 He et al. ..... 439/660

OTHER PUBLICATIONS

SFF Committe SFF-8149 Specification for 54mm × 78.5mm Form Factor with USB 3.0 Combination Connector Rev 0.1 Nov. 24, 2009.
SFF Committee SFF-8248 Specification for 2.5" Drive Form Factor with USB 3.0 Combination Connector Rev 0.2 Nov. 24, 2009.
SFF Committee SFF-8348 Specification for 3.5" Drive Form Factor with USB 3.0 Combination Connector Rev 0.2 Nov. 24, 2009.

* cited by examiner

*Primary Examiner* — Javaid Nasri
(74) *Attorney, Agent, or Firm* — Wei Te Chung; Andrew C. Cheng; Ming Chieh Chang

(57) ABSTRACT

An electrical connector assembly includes a first and a second electrical connector each having two connector ports. The first connector port of the first connector has an insulating mating tongue with a plurality of contacts thereon and an insulating protecting frame arranged side by side with the mating tongue along a longitudinal direction of the first connector and spaced away from the mating tongue. The second connector port is received in the protecting frame and has a shielding shell surrounding therearound.

20 Claims, 10 Drawing Sheets

COMBO ELECTRICAL CONNECTOR

BACKGROUND OF THE INVENTION

1. Field of the Invention

The present invention relates to an electrical connector having a plurality of connector ports arranged side by side, and particularly to a USB port and a power port.

2. Description of Related Arts

Recently, personal computers (PC) are used in a variety of techniques for providing input and output. Universal Serial Bus (USB) is a serial bus standard to the PC architecture with a focus on computer telephony port, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

With the requirement of data transmission speed is higher and higher, the speed of a USB 2.0 plug is insufficient to support high-speed transmission between external devices. Therefore the USB specification is developed at a higher version of USB 3.0. A standard USB 3.0 accelerating data transmission to 4.8 Gbps, is designed to be backwards-compatible with USB 2.0.

The USB 3.0 Connectors and Cable Assemblies have three types, Type A, Type B, and Type Micro B receptacles, plugs and wire harness arrangement. Said three types of connectors, including plugs and receptacles, have different contour configuration), resulting in independent usage by themselves to certain extent. USB 3.0 type Micro B includes two mating interface separated from each other by a partition wall integrated with the shell. USB 3.0 Type Micro B as known so far will commonly be used in consumer electronic devices. So there is a hope to initiate a USB 3.0 Type Micro B carrying other interfaces which can be used in other applications.

Hence, a new electrical connector is desired.

SUMMARY OF THE INVENTION

An electrical connector assembly comprises a first electrical connector and a second electrical connector. The first electrical connector comprises a first connector port which has an insulating mating tongue with a plurality of contacts thereon, an insulating protecting frame arranged side by side with the mating tongue along a longitudinal direction of the first electrical connector and spaced away from the mating tongue and a second connector port receiving in the protecting frame. The first connector port has a shielding shell surrounding therearound. The electrical second connector mating with the first electrical connector, comprises a third connector port which has a mating slot to receive the mating tongue and a forth connector port to receive in the second connector port. The forth connector port has a shielding shell surrounding therearound.

Other advantages and novel features of the invention will become more apparent from the following detailed description of the present embodiment when taken in conjunction with the accompanying drawings

DETAILED DESCRIPTION OF THE PREFERRED EMBODIMENT

Further detailed description of the preferred embodiments of this present invention is set forth below along with the attached drawings.

Figure 1:
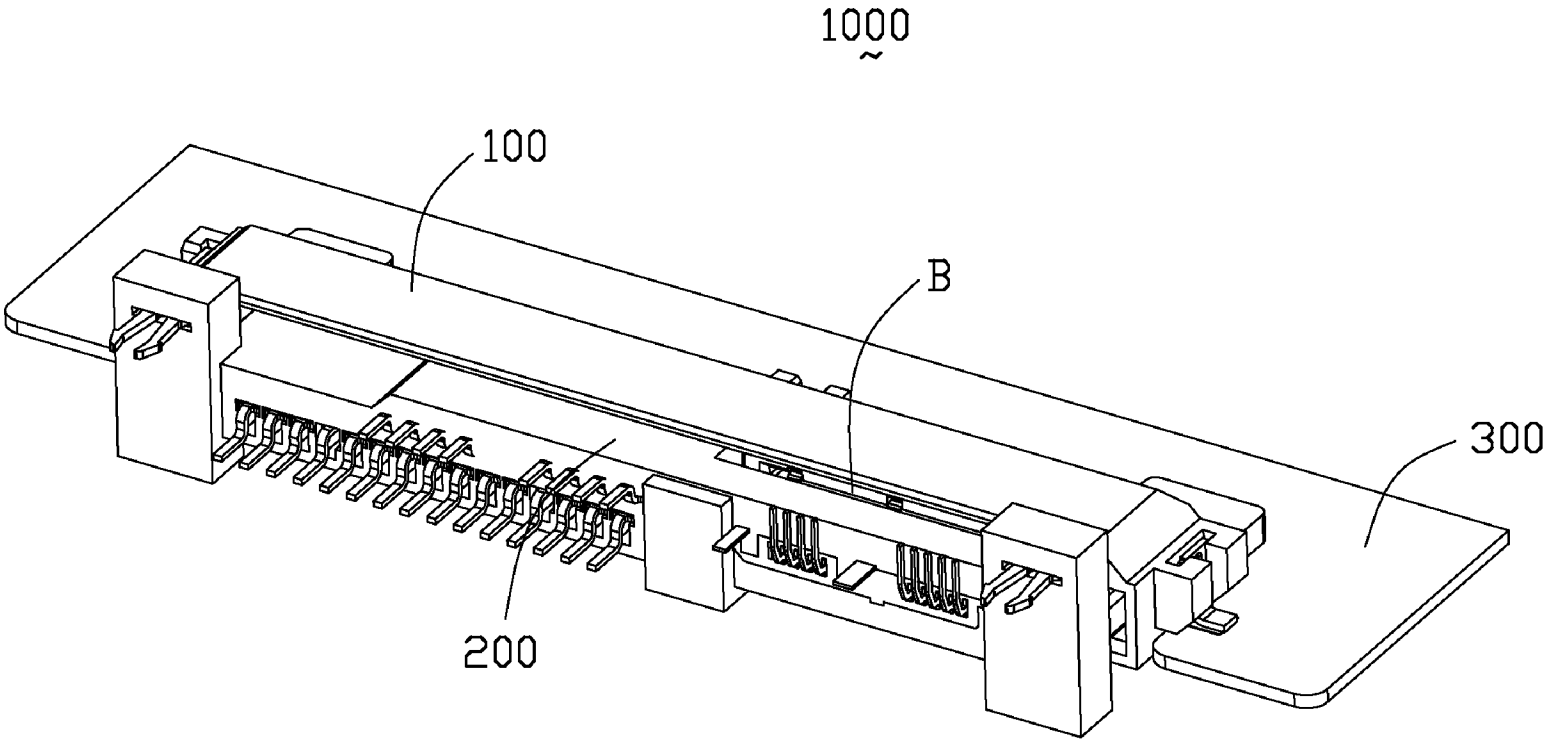
FIG. 1 is a perspective view of an electrical connector assembly mounted on a printed circuit board of a first embodiment in accordance with the present invention, wherein two electrical connectors engage with each other together.
Figure 2:
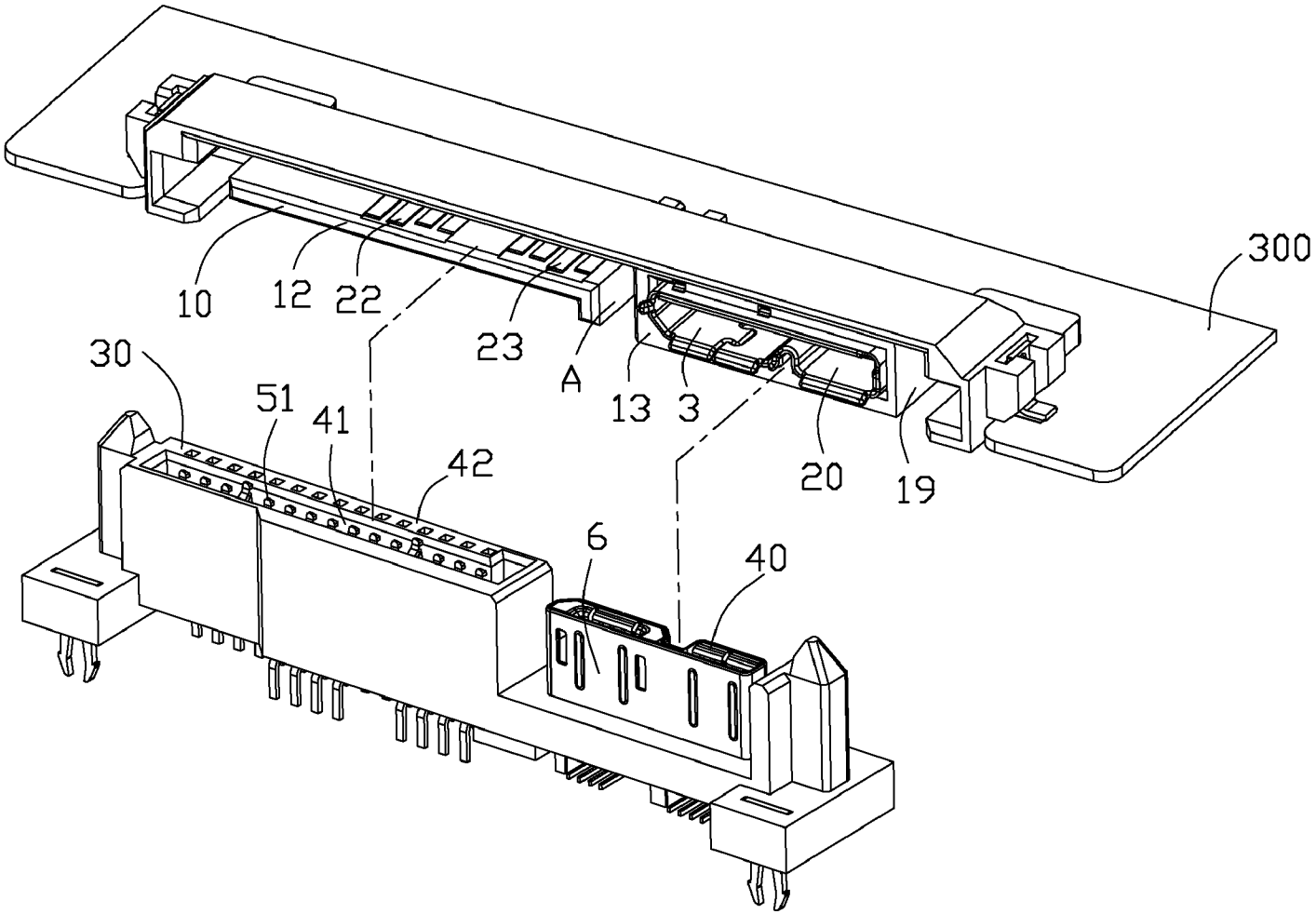
FIG. 2 is a perspective view of the electrical connector assembly wherein the two electrical connectors disconnect from each.

Referring to FIGS. 1&2 showing an electrical connector assembly 1000, the assembly 1000 includes a first electrical connector 100 which is adapted for setting in device equipment, mounted on a printed circuit board 300 and a second electrical connector 200 which is adapted for mating with the first electrical connector 100 on system equipment. The first connector 100 includes two connector ports 10, 20 which are defined to complete a functional electrical connection. The first connector port 10 includes a mating tongue 12 and a plurality of contacts 22, 23, 21 which are arranged along the longitudinal direction of the connector on an upper surface and a lower surface of the tongue portion 11. The second connector port 20 is configured by a shielding shell 3 surrounding a plurality of contacts to constitute a mating port. The first connector port 10 is adapted for power segment and the second connector port 20 is adapted for USB 3.0 Micro B type which is backward to a USB 2.0 Micro B type. The first connector 100 further include a protecting frame 13 which is arranged side by side with the mating tongue 12 along a longitudinal direction of the connector and spaced from the mating tongue 12 with a distance A. The second connector port 20 is located in and supported by the protecting frame 13 since the inside of the protecting frame 13 conform to the outline of the first connector port 10. Thus, the connector ports 10, 20 are arranged side by side along the longitudinal direction of the connector.

The second electrical connector 200 of backplane connector type is adapted for mating with said first electrical connector 100. The second connector 200 has a third connector port 30 and a forth connector port 40 arranged side by side and spaced from each other along the longitudinal direction. The third connector port 30 includes a forward opening inverted L shaped mating slot 41 surrounded by four side wall 42 and a plurality of contacts 51 exposed to the mating slot. The forth connector port 40 surrounds with a shielding shell 6 thereaournd.

Figure 3:
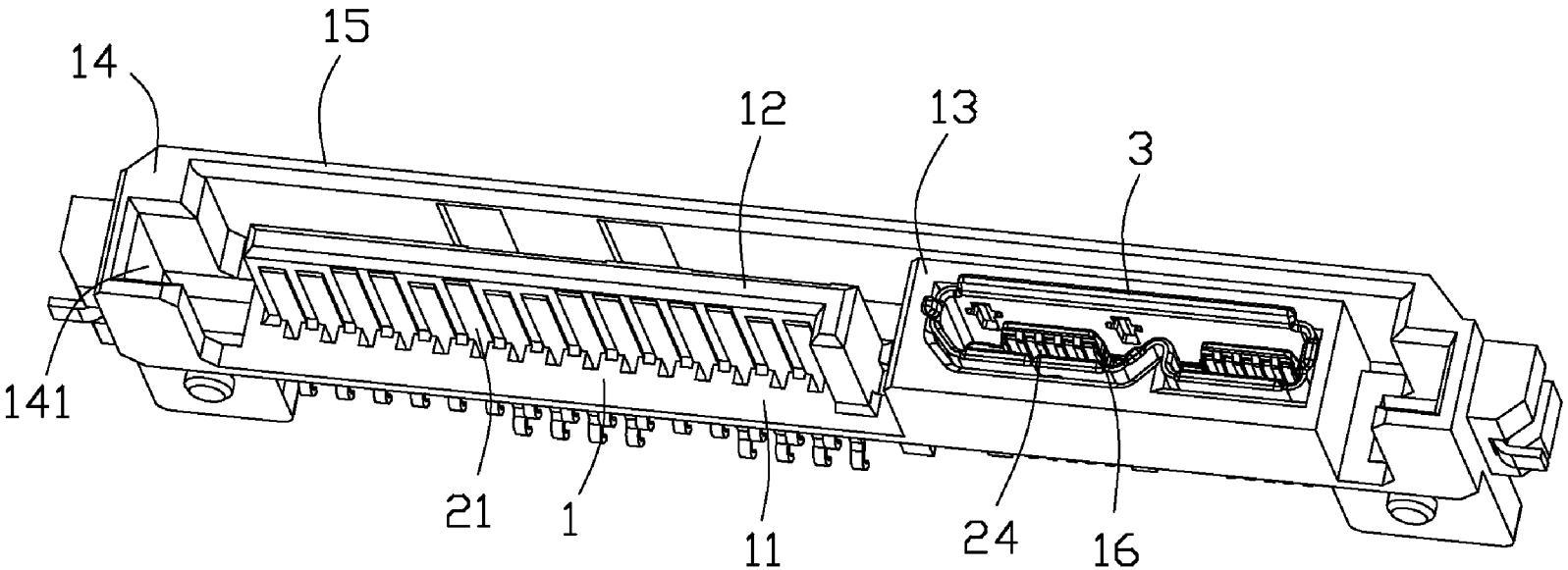
FIG. 3 is a perspective view of the first electrical connector.
Figure 4:
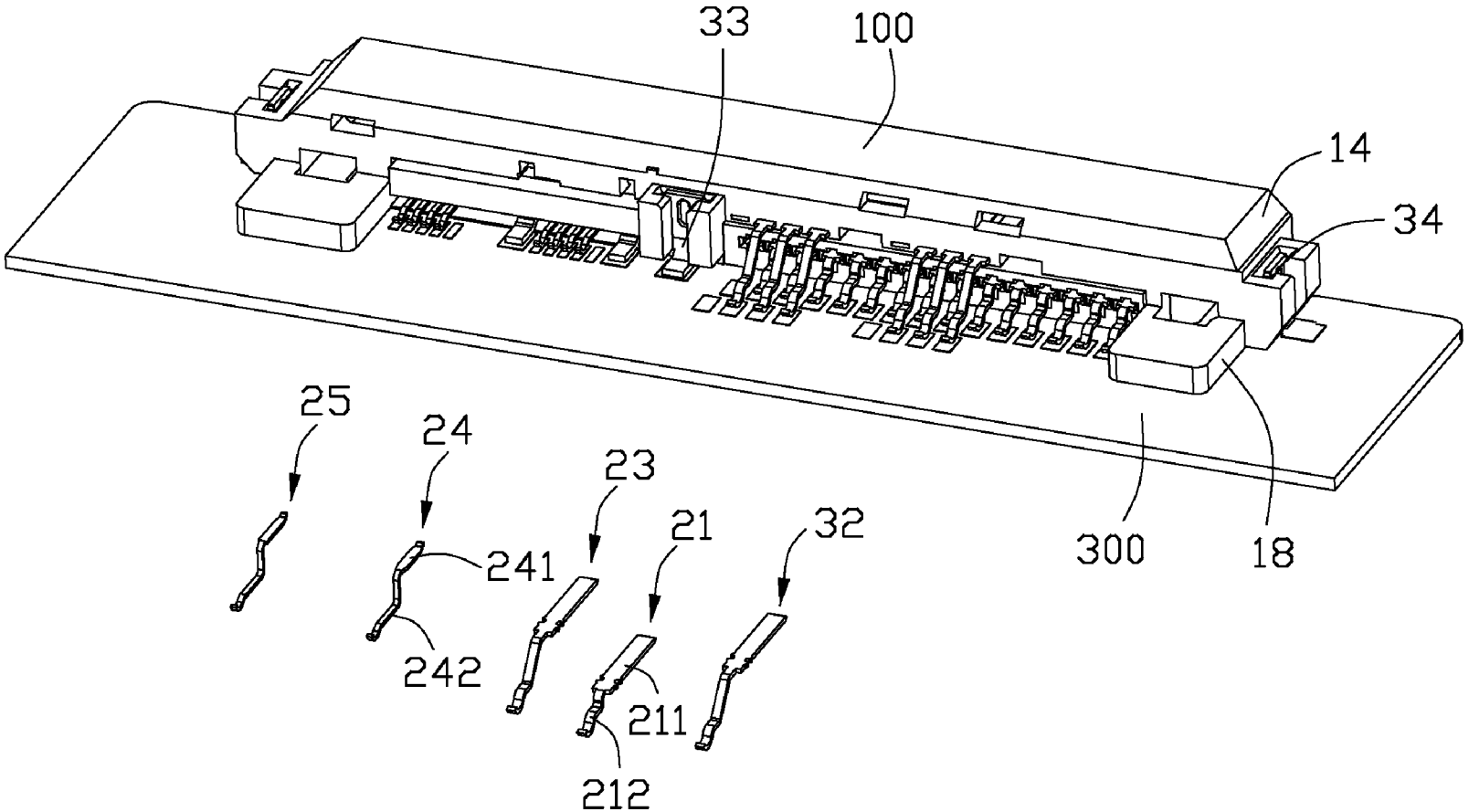
FIG. 4 is a perspective, partially exploded view of the first electrical connector.

A detailed illustration of the first connector 100 and the second connector 200 will be given hereinafter. Referring to FIGS. 3 and 4, the first connector 100 includes an insulating base 1 which includes a base/rear wall 11, two end walls 14 at two opposite ends of the base wall 11 and a side wall 15 jointed with said two end walls 14. The side wall 15 is located at one side of the mating tongue 12 and the protecting frame 13, and the end walls 14 separate from the mating tongue 12 and the protecting frame 13. Each end wall 14 defines a guiding recess 141 opening forwards and inwards to face one ends of the mating tongue 12 and protecting frame 13. Said end walls 14, side wall 15, mating tongue 12 and protecting frame 13 integrally extend forwards from the base wall 11. The mating tongue 12 separates from the side wall 15 while the protecting frame 13 is unitary with the side wall 15.

The plurality of the contacts 21 on the lower face of mating tongue 12 and the plurality of contact 22, 23 on the lower face of the mating tongue of the first connector port 10, each has a non-elastic plate contacting portion 211 and a leg portion 212 elastically abutting against the PCB 300. The leg portions 212 bend three times so as to increase the elastic performance of the leg portions. The plurality of contacts 24, 25 arranged on the lower face of two mating tongue 16 of the second connector port 20, each has a non-elastic plate contacting portion 241 and an abutting leg portion 242.

Figure 5:
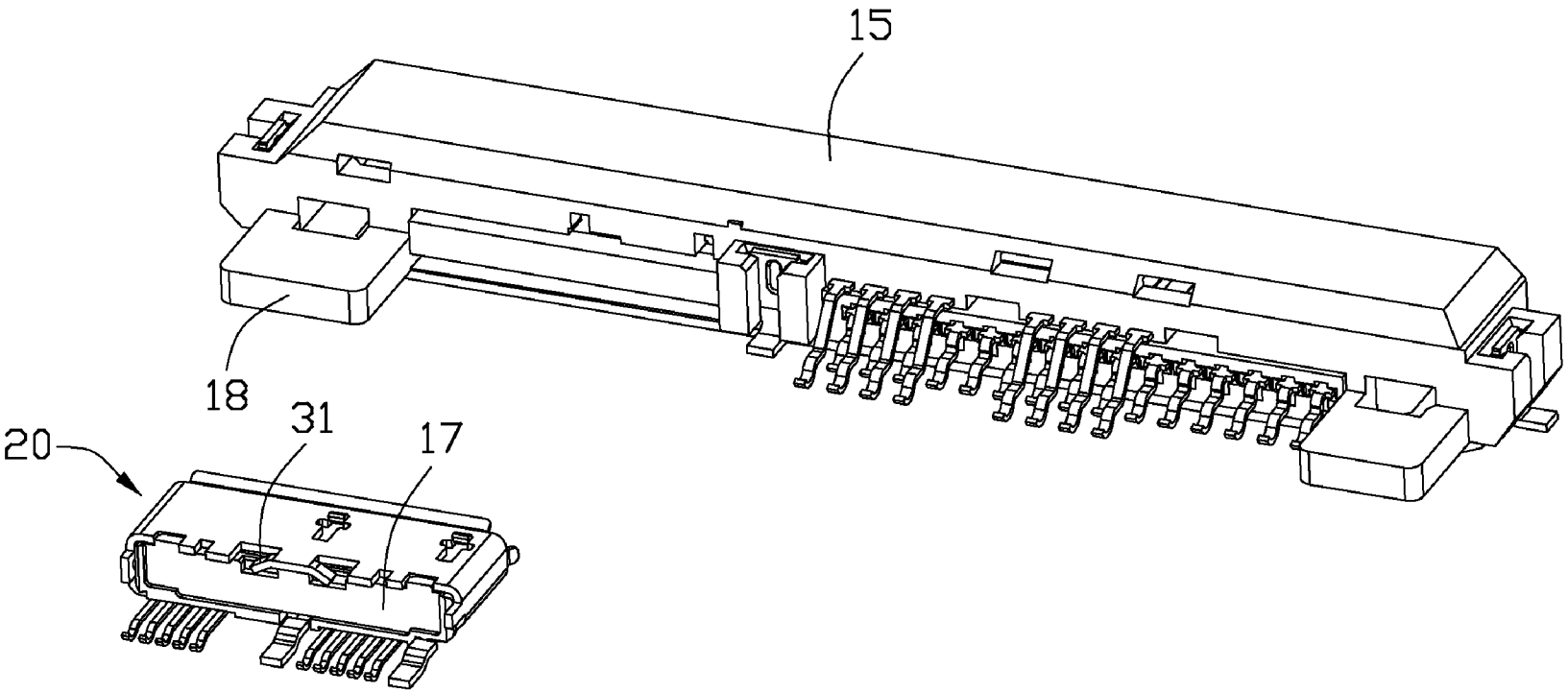
FIG. 5 is a perspective, partially exploded view of the first electrical connector.

Please referring to FIGS. 3 and 5, the second connector port 20 is formed by the shielding shell 3 surrounding the insulating seat 17 which extends forwards said two mating tongues 16. The mating tongues are partitioned by a rib integrally projecting inwards from the shielding shell. The shell 3 is retained with the insulating seat by barbs 31 of the shell 3. A metal ear 33 is retained on the rear face of the base wall 11 and between said two connector ports 10, 20 and two another metal ears 34 are retained in outer of the end wall 14. A pair of rear flanges 18 abuts against the PCB.

Figure 6:
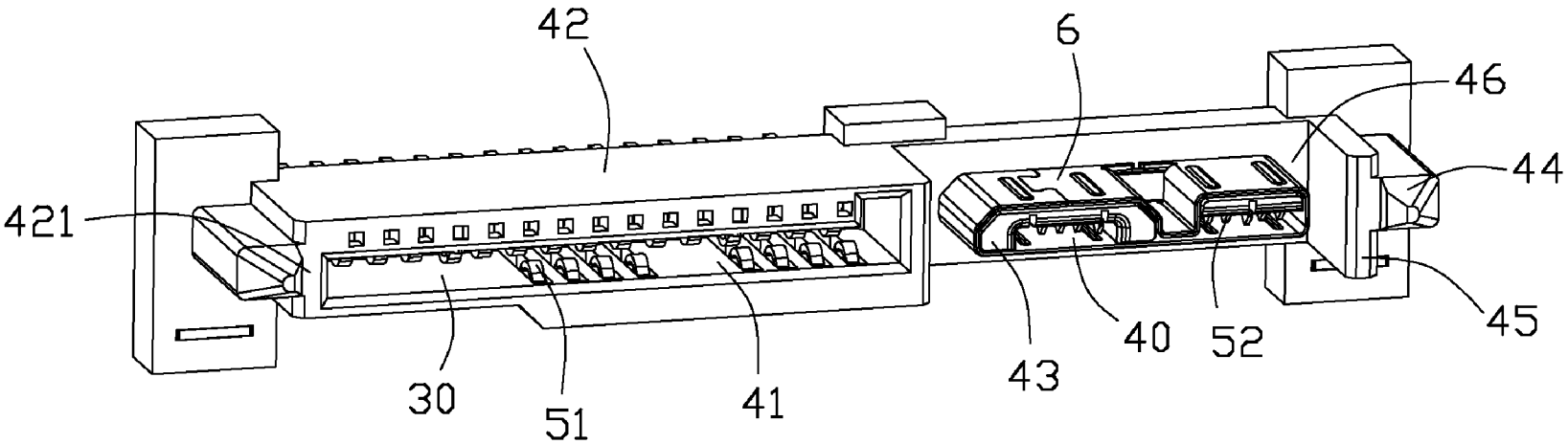
FIG. 6 is a perspective view of the second electrical connector.
Figure 7:
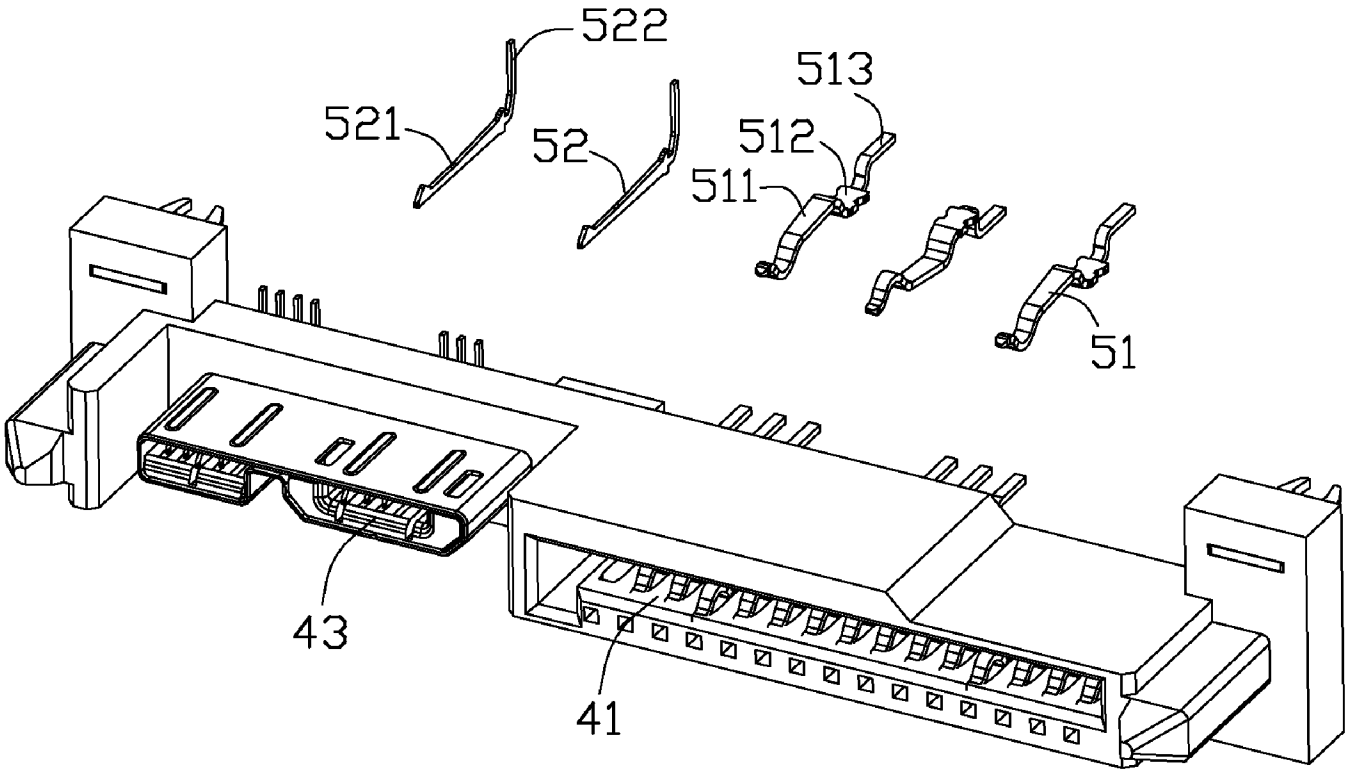
FIG. 7 is a perspective, partially exploded view of the second electrical connector.

Referring to FIGS. 6&7 showing the second electrical connector 200. The third connector port 30 includes a forward opening L shaped mating slot 41 surrounded by four side walls 42 and a plurality of contacts 51 received in the mating slot. The forth connector 40 includes two insulating seats 43 with a plurality of contacts 52 retained therein and a shielding shell 6 surrounding the insulating seat 43 so that two mating ports are defined. A pair of guiding post 44 is disposed on two ends of the electrical connector. One guiding post unitarily juxtaposes with one side wall 421 of the third connector port 30 and another guiding post unitarily juxtaposes against an end wall 45 which separates from the forth connector port 40 with a gap 46. The end wall 45 is inserted into a gap 19 as shown in FIG. 2 defined between the protecting frame 13 and end wall 14 of the first electrical connector 100.

The contacts 51 are divided into three sets, a first set is located in one side of the mating slot 41 and a second and a third sets are in another side of the mating slot 41. The contact includes an elastic contacting portion, a plate solder leg portion 513 and a retaining portion joined with said two portions 511,513 and retaining the contact 51 in the insulating base. The contacts 52 are divided in two sets to receive in said two insulating seats 43. The contact 52 includes a contacting portion 521 and a leg portion 522.

Figure 8:
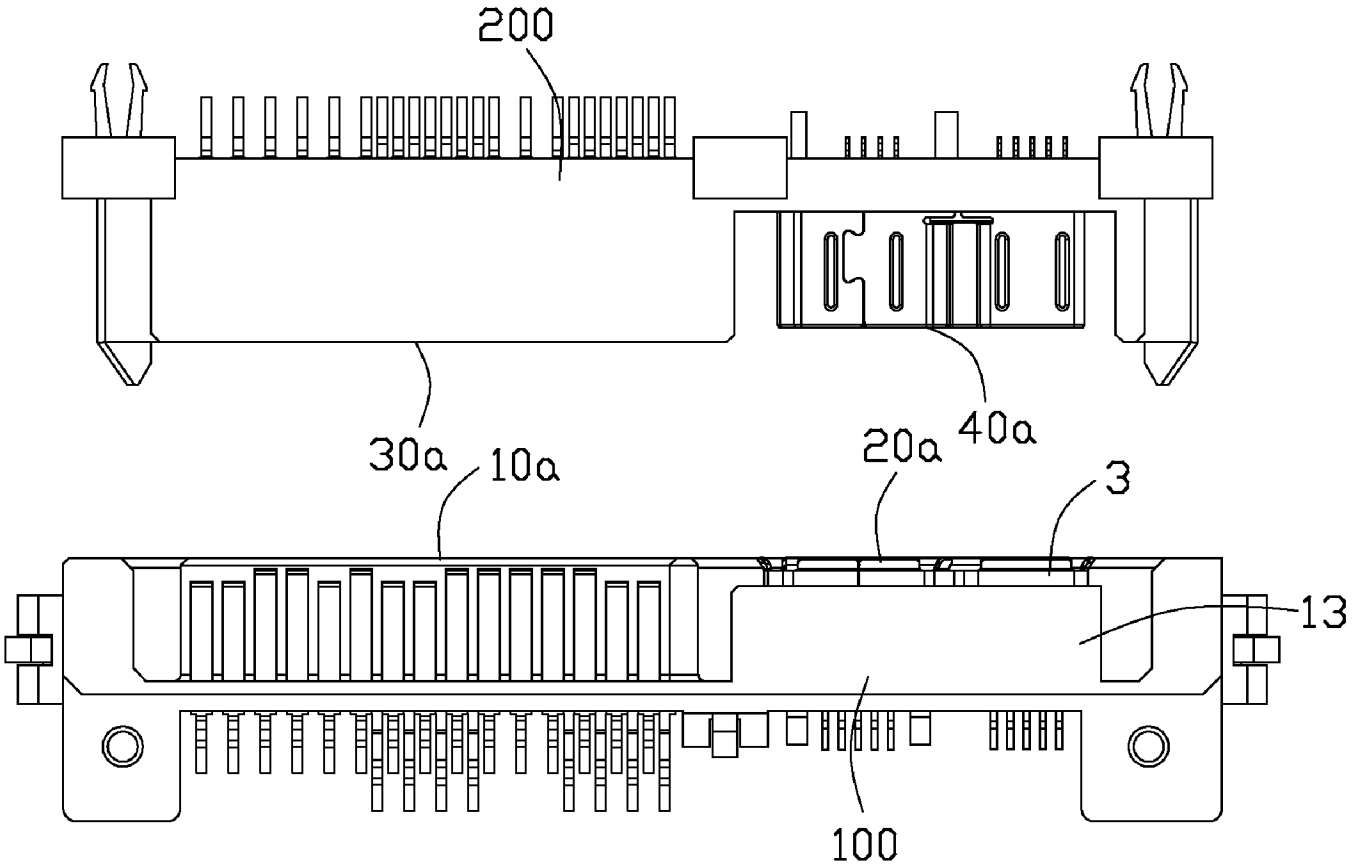
FIG. 8 is a bottom plan view of the two electrical connectors.

FIG. 8 shows the bottom view of said electrical connectors. Combination with FIG. 2, each of said four connector ports has a front mating edge which may be one point, one line or one plane to be engaged with a corresponding connector port firstly. Said four front mating edges are designated as 10*a*, 20*a*, 30*a*, 40*a*. The first front mating edge 10*a* of the first connector port 10 and the second front mating edge 20*a* of the second connector port are at a same level substantially and the second front mating edge 20*a* projects forward than the protecting frame 13. The third front edge 30*a* of the third connector port 30 projects forward relative to the forth front mating edge 40*a* of the forth connector port 40, i.e., the forth front mating edge 40*a* pulls back USB 3.0 Micro B Type has two port portions side by side and partitioned relative to the third front mating edge 30*a*. The front portion of the shielding shell 3 exposes an exterior of the protecting frame 13. As shown in FIG. 1, after assembly of the two connectors, a gap B is left between the second connector port and the forth connector port.

Figure 9:
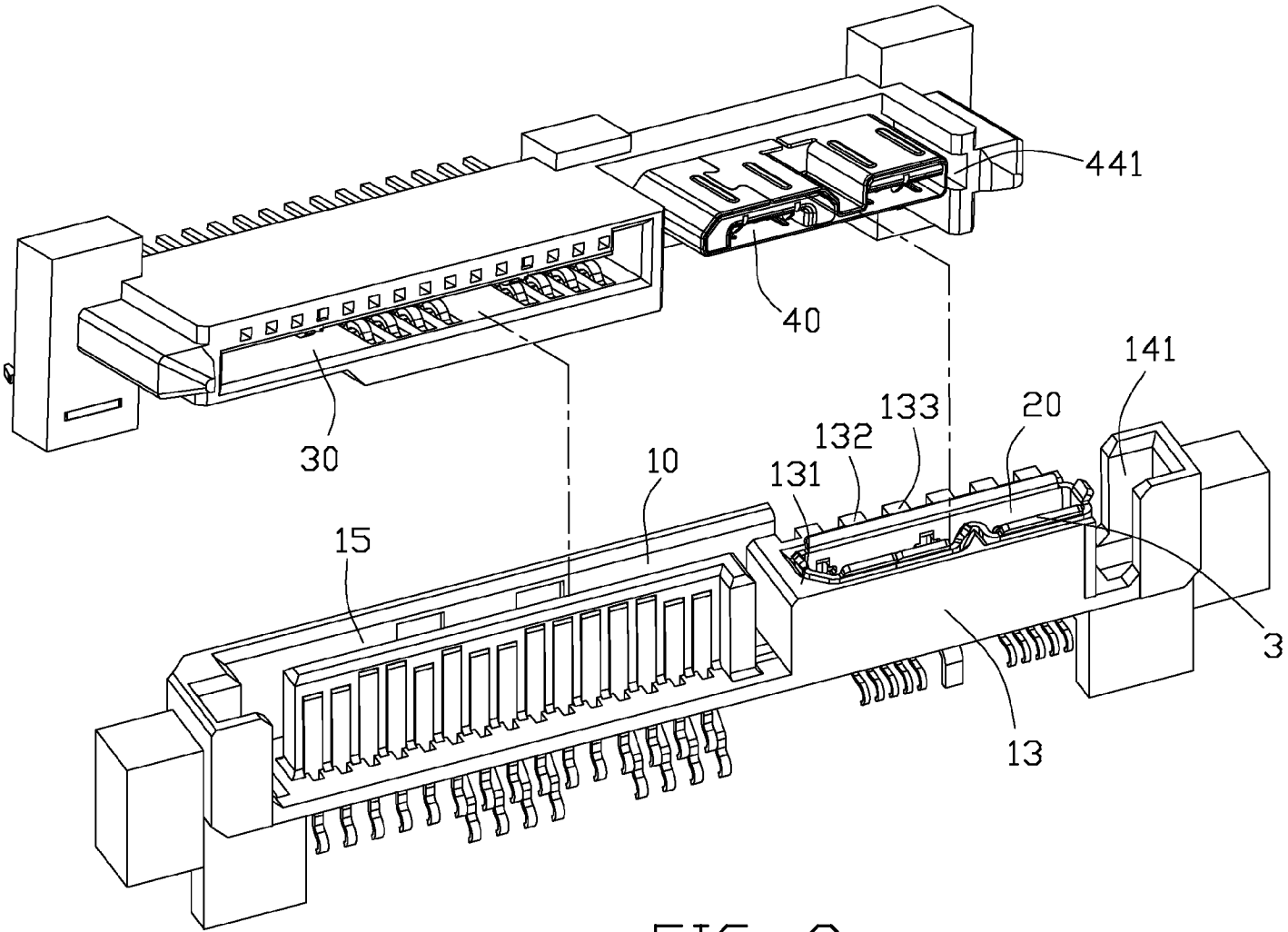
FIG. 9 is a perspective view of an electrical connector assembly of a second embodiment in accordance with the present invention, wherein two electrical connectors disconnect from each other.
Figure 10:
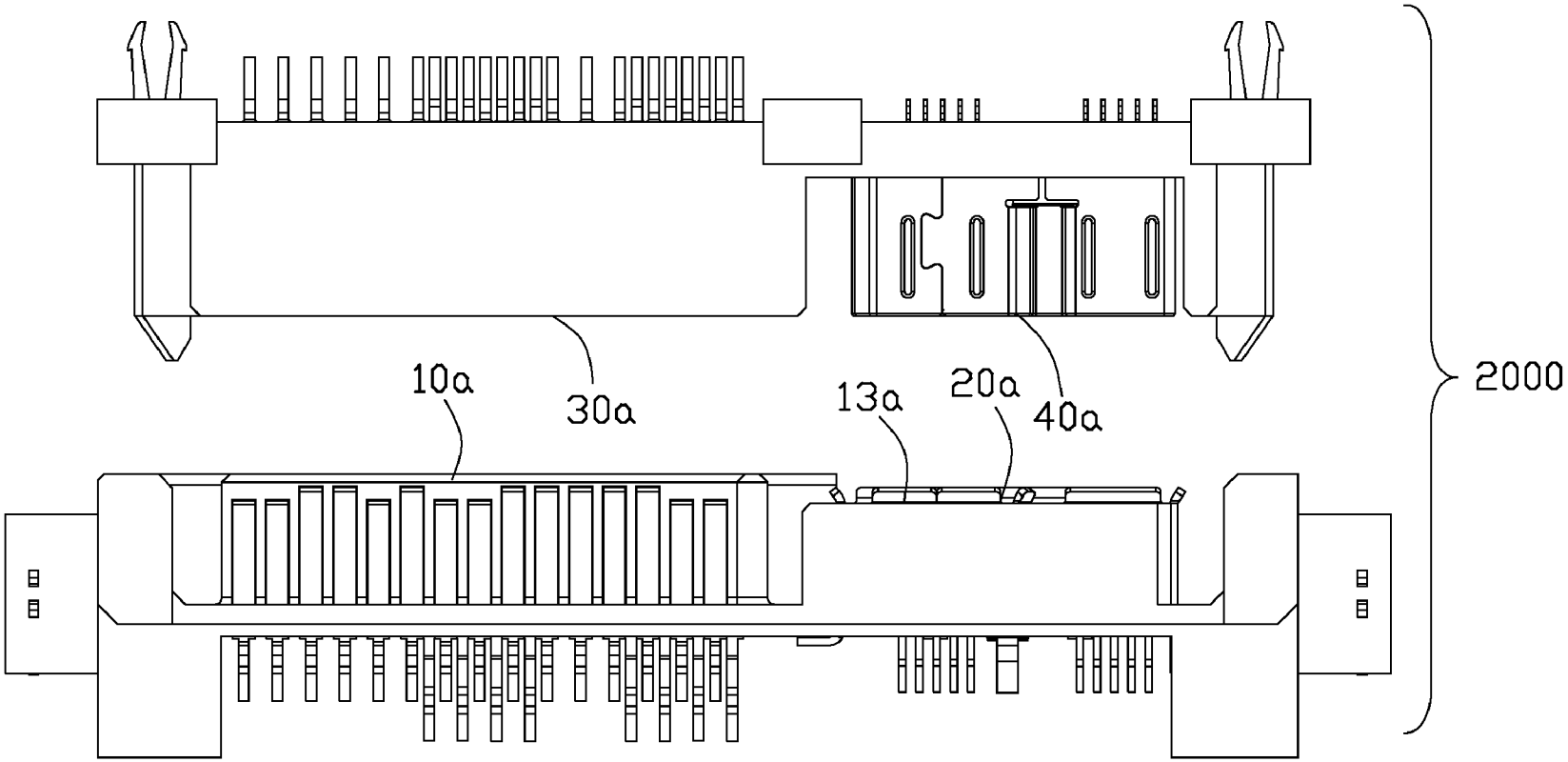
FIG. 10 is a bottom plan view of the two electrical connectors showing in FIG. 9.

FIGS. 9 and 10 show a second embodiment of an electrical connector assembly 2000 of the present invention. Only different structure of the assembly from the aforementioned embodiment will be given below wherein the same and similar elements are designated by same or similar reference numerals. The side wall 15 shorts and is unitary with one end wall 131 of the protecting frame. The top side wall 132 of the projecting frame 13 has a plurality of ribs 133. One side opposite to said one end wall 131 is empted so that the shielding shell 3 directly faces to the guiding recess 141 while the remainder is surrounded by the frame. The end wall 44 of the second connector 200 has a shallow recess 441. The third front mating edge 30*a* and the forth front mating edge 40*a* are located a same level. The first front mating edge 10*a* projects forward beyond the second front mating edge 20*a*, and the front mating edge 20*a* and a front edge 13*a* of the projecting frame are substantially at a same level. Please notes that the name of the first through the forth is only for convenient description.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector assembly comprising:

a first electrical connector comprising a first connector port and a second port arranged side by side;

a second electrical connector mating with the first electrical connector, comprising a third connector port and a forth port arranged side by side;

said four connector ports each defining a front mating edge for being inserted into each other firstly respectively;

wherein the front mating edge of the first and the second connector ports are at a same level substantially while the front mating edge of the third connector port project forwards relative to the front mating edge of forth connector port.

2. The electrical connector assembly as described in claim 1, wherein the third connector port comprises a mating slot surrounded by a plurality of sidewalls and opening forwards and a plurality of contacts exposing to the mating slot.

3. An electrical connector assembly comprising:

a receptacle connector defining an elongated insulative housing defining a lengthwise direction and a mating direction perpendicular to said lengthwise direction;

a first connection port including a first tongue receiving cavity circumferentially surrounded by a first mating portion of the housing and communicating with an exterior in said mating direction;

a plurality of first contacts disposed in the first mating portion of the housing with first mating sections exposed into the tongue receiving cavity;

a second connection port located beside the first connection port in said lengthwise direction with a gap therebetween, said second connection port defining at least a second tongue receiving cavity defined by a second mating portion of the housing and a corresponding metallic shell which circumferentially surrounds said second mating portion;

a plurality of second contacts disposed in the second mating portion of the housing with second mating sections extending into the second tongue receiving cavity;

the receptacle connector further including a guiding post located one side of the second connection port opposite to said first connecting port in said lengthwise direction; wherein said second connection port is spaced from said guiding post in said lengthwise direction with another gap;

further including a plug connector defining another elongated insulative housing with a third connection port and the fourth connection port side by side arranged with each other in said lengthwise direction to mate with the corresponding first connection port and second connection port, respectively; wherein the third connection port includes a tongue having a plurality of third contacts thereon and extending forwardly in the mating direction to be received in the first tongue receiving cavity, and the fourth connection port includes another metallic shell with therein at least another tongue having a plurality of fourth contacts thereon and extending forwardly in the mating direction to be received in the second tongue receiving cavity under condition that said another metallic shell encloses said metallic shell during mating; wherein the housing of the plug connector includes an elongated side wall to enclose at least one of said third connection port and said fourth connection port in a vertical direction perpendicular to both said mating direction and said lengthwise direction.

4. The electrical connector assembly as claimed in claim 3, wherein the second connection port is rearwardly offset from the first connection port and the guiding post in said mating direction.

5. The electrical connector assembly as claimed in claim 3, wherein one half side of the second tongue receiving cavity is enclosed by the second mating portion of the housing, and another half side of the second tongue receiving cavity is enclosed by the shell.

6. The electrical connector assembly as claimed in claim 3, wherein said receptacle connector further includes another guiding post located on one side of the first connection port opposite to the second connection port in said lengthwise direction.

7. The electrical connector assembly as claimed in claim 6, wherein said plug connector comprises a pair of guiding recesses to receive said two guiding posts, the guiding recesses open toward each other in the lengthwise direction.

8. The electrical connector assembly as claimed in claim 3, wherein prior to mating, the metallic shell of the second mating port is upwardly and downwardly exposed to an exterior in said vertical direction.

9. The electrical connector assembly as claimed in claim 3, wherein said elongated side wall extends forwardly beyond said third connection port and said fourth connection port.

10. The electrical connector assembly as claimed in claim 9, wherein said elongated side wall encloses both said third connection port and said fourth connection port in said vertical direction.

11. The electrical connector assembly as claimed in claim 10, wherein in said fourth connection port, said another metallic shell is enclosed circumferentially by other mating portion of said another housing.

12. The electrical connector assembly as claimed in claim 11, wherein said elongated side wall is unitarily formed with said another mating portion of said another housing in said vertical direction.

13. An electrical connector assembly comprising:

a first electrical connector comprising:

a first mating tongue with a plurality of first contacts disposed thereon, a first shielding shell, a pair of end walls at opposite ends of the first mating tongue and the first shielding shell, arranged side-by-side along a longitudinal direction of the first electrical connector;

the end walls each defining a guiding recess communicating with an exterior in a mating direction perpendicular to the longitudinal direction and facing one ends of the first mating tongue and the first shielding shell along the longitudinal direction:

a side wall integrally connecting with the end walls along the longitudinal direction and located at and spacing apart from one side of the first mating tongue and the first shielding shell:

the first shielding shell surrounding at least one second mating tongue therein and a plurality of second contacts disposed on the at least one second mating tongue; and a second electrical connector intended to mate with the first electrical connector, comprising:

a mating portion with a first tongue receiving cavity with a plurality of third contacts exposing therein to receive the first mating tongue of the first electrical connector, a second shielding shell to be inserted in the first shielding shell of the first electrical connector and a pair of guiding posts to be inserted in the guiding recesses of the first electrical connector;

the second shielding shell enclosing an insulating base to commonly define at least one second tongue receiving cavity with a plurality of fourth contacts exposing therein to receive the at least one second tongue of the first electrical connector:

wherein the mating portion of the second electrical connector is sandwiched directly by the first mating tongue and the side wall of the first electrical connector.

14. The electrical connector assembly as claimed in claim 13, wherein the end walls, first mating tongue and the first shielding shell separate from each other with a gap along the longitudinal direction.

15. The electrical connector assembly as claimed in claim 14, wherein the first electrical connector comprises a longitudinal insulating base, the first mating tongue and the end walls integrally extend from the longitudinal base in the mating direction; the second connector comprises a longitudinal base, the mating portion and the guiding posts integrally extend from the longitudinal base opposite to the mating direction.

16. The electrical connector assembly as claimed in claim 15, wherein the second shielding shell is rearwardly offset from the mating portion of the second electrical connector.

17. The electrical connector assembly as claimed in claim 13, wherein the first shielding shell is enclosed circumferentially with an insulating protecting frame.

18. The electrical connector assembly as claimed in claim 17, wherein the insulating protecting frame is integrally formed with the side wall.

19. The electrical connector assembly as claimed in claim 18, wherein the insulating projecting frame is rearward offset from the first shielding shell.

20. The electrical connector assembly as claimed in claim 13, wherein said side wall extends forwardly beyond the first mating tongue and the protecting frame.

* * * * *